US012396584B2

(12) United States Patent
Burk et al.

(10) Patent No.: US 12,396,584 B2
(45) Date of Patent: Aug. 26, 2025

(54) HYDROPONIC FEED INDICATION APPARATUS

(71) Applicant: Brandon A. Burk LLC, Beaumont, CA (US)

(72) Inventors: Brandon Aubrey Burk, Beaumont, CA (US); Janell Ann Burk, Beaumont, CA (US)

(73) Assignee: Brandon A. Burk, LLC, Beaumont, CA (US)

( * ) Notice: Subject to any disclaimer, the term of this patent is extended or adjusted under 35 U.S.C. 154(b) by 303 days.

(21) Appl. No.: 18/305,874

(22) Filed: Apr. 24, 2023

(65) Prior Publication Data

US 2024/0349926 A1 Oct. 24, 2024

(51) Int. Cl.
*A47G 33/12* (2006.01)

(52) U.S. Cl.
CPC ..... *A47G 33/12* (2013.01); *A47G 2033/122* (2013.01); *A47G 2033/124* (2013.01); *A47G 2033/1293* (2013.01)

(58) Field of Classification Search
CPC ..... A47G 33/12; A47G 2033/122; A47G 2033/124; A47G 2033/1293
See application file for complete search history.

(56) References Cited

U.S. PATENT DOCUMENTS

| | | | | | |
|---|---|---|---|---|---|
| 4,930,252 | A * | 6/1990 | Krause | A47G 33/12 | 47/62 R |
| 5,493,277 | A * | 2/1996 | Pierce | A47G 33/12 | 47/79 |
| 5,535,547 | A | 7/1996 | Brunengo | | |
| 5,661,926 | A * | 9/1997 | Granger | A01G 25/14 | 47/40.5 |
| 5,799,437 | A * | 9/1998 | Evans | A01G 27/005 | 340/618 |
| 5,835,018 | A * | 11/1998 | Kursel | A01G 27/008 | 73/304 R |
| 6,082,043 | A * | 7/2000 | Andrews | A47G 33/0881 | 340/618 |
| 10,631,478 | B2 | 4/2020 | Moran et al. | | |
| 2011/0214345 | A1* | 9/2011 | Rasschaert | A47G 33/12 | 340/618 |
| 2018/0105409 | A1 | 4/2018 | Bernaski | | |

* cited by examiner

*Primary Examiner* — Thomas D Alunkal
(74) *Attorney, Agent, or Firm* — Jeremy Briggs

(57) ABSTRACT

A hydroponic feed indication apparatus is disclosed. The apparatus may include a hollow body having a distal body portion and a proximal body portion. The distal body portion may be inserted into a tree stand, and the proximal body portion may receive fluid via a proximal body portion top end. The apparatus may further include an anode electrode and a cathode electrode disposed at a distal body portion exterior surface. The anode electrode may move along a distal body portion length via a first elongated slit disposed on the distal body portion. The cathode electrode may move along the distal body portion length via a second elongated slit disposed on the distal body portion. The apparatus may further include a fill level indicator disposed on the body. The fill level indicator may activate when the fluid shorts the anode electrode and the cathode electrode.

20 Claims, 5 Drawing Sheets

HYDROPONIC FEED INDICATION APPARATUS

TECHNICAL FIELD

The present disclosure relates to a hydroponic feed indication apparatus, and more specifically to a hydroponic feed indication apparatus that is configured to indicate water level in a tree stand, and facilitate feeding of water in the tree stand.

BACKGROUND

Many users keep trees indoors in their homes for decorative purposes or for festivals. For example, many users keep Christmas trees in their homes during Christmas. Typically, the trees are placed in tree stands that support the tree trunk and provide stable base to the trees. The trees may be required to be watered regularly to keep them alive and in healthy condition when they are kept indoors.

The trees are typically watered by adding water to the tree stands in which the trees may be placed. Adding water to the tree stands may be a tedious and challenging task for the users. For example, the breadth of tree branches may make it challenging for the users to reach to the tree stand and add water. Further, there may be instances where the users may overfill the tree stand, which may result in water spillage.

Thus, there is a need for an apparatus that may facilitate the users in watering the trees placed in the tree stands, and minimize water spillage.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
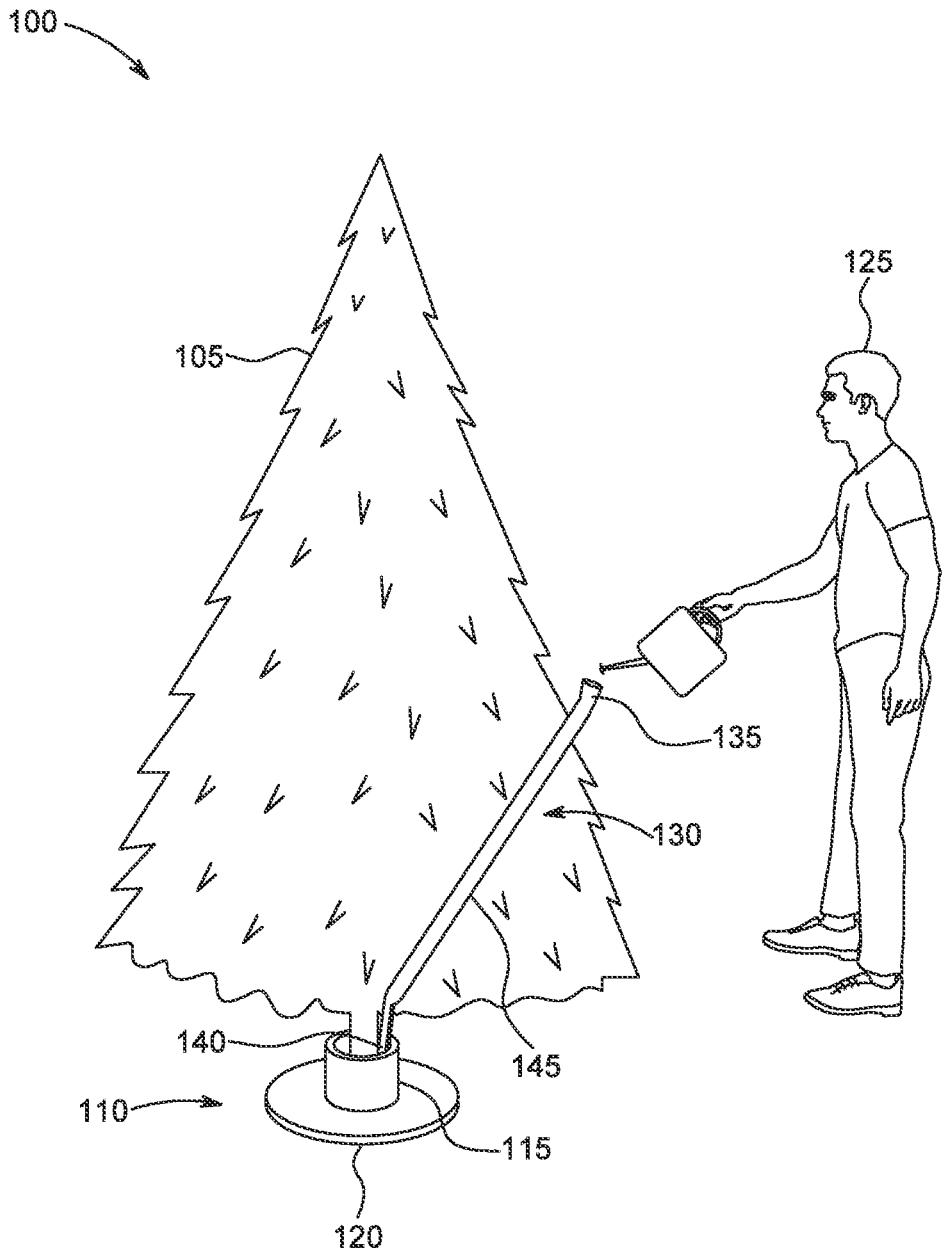
FIG. 1 depicts an example environment in which techniques and structures for providing the systems and methods disclosed herein may be implemented.

The present disclosure is directed towards a hydroponic feed indication apparatus that may indicate water level in a tree stand configured to house a tree, e.g., a Christmas tree. The apparatus may include an ergonomic hollow body having a proximal body portion and a distal body portion. The distal body portion may be inserted into the tree stand that may house a tree trunk. The proximal body portion may be shaped as a funnel that may enable a user to add water to the proximal body portion. The water added to the proximal body portion may flow into the tree stand via the distal body portion, thus watering the tree trunk.

In some aspects, the distal body portion may include anode and cathode electrodes that may be connected to a fill level indicator disposed at a proximal body portion top end via insulated wires. The anode and cathode electrodes may be disposed on a distal body portion exterior surface, and may be configured to move up or down along a distal body portion length. In some aspects, only one electrode of the anode and cathode electrodes may be configured to move up or down along the distal body portion length. In this case, one electrode (e.g., the cathode electrode) may be fixed in proximity to a bottom end of the distal body portion, and the second electrode (e.g., the anode electrode) may be configured to move up or down along the distal body portion length. In other aspects, both the anode and cathode electrodes may be configured to move up or down along the distal body portion length. A user may adjust the position of anode and/or cathode electrodes along the distal body portion length based on a maximum level of water that the user may desire to fill in the tree trunk. When the user may be adding water to the tree stand via the apparatus (specifically via the proximal body portion) and the water reaches to the maximum level desired by the user, the anode and cathode electrodes may short due to presence of water. Shorting of anode and cathode electrodes may illuminate the fill level indicator, thus providing an indication to the user that the water in the tree stand may have reached the desired maximum level. At this point, the user may stop adding further water to the apparatus, thus preventing overfilling of water in the tree stand. The apparatus may further include a power source (e.g., rechargeable batteries) that may power the fill level indicator.

In further aspects, the apparatus may include a sensor configured to generate a signal when the sensor may not be in contact with water. The sensor may be disposed at the distal body portion, and may indicate when the water level in the tree stand may be lower than a predefined threshold. Specifically, the sensor may generate the signal when the water level in the tree stand drops below the predefined threshold (at this point, the sensor may not be in contact with water), thus indicating that water may need to be replenished in the tree stand.

The apparatus may further include a controller that may receive the signal from the sensor, and may illuminate the fill level indicator in a predetermined pattern (e.g., by flashing light) responsive to receiving the signal. Fill level indicator illumination in the predetermined pattern may provide an indication to the user that water may need to be replenished in the tree stand. The apparatus may further include a speaker that may be activated by the controller responsive to receiving the signal from the sensor. The speaker may output a predetermined sound (e.g., a song) responsive to being activated by the controller. In further aspects, the controller may wirelessly transmit an alert notification to a user device associated with the user when the controller receives the signal from the sensor.

In additional aspects, the apparatus may be connected with an external pump that may transfer water and/or additives from an external reservoir to the tree stand via the apparatus, when the external pump may be activated. In some aspects, the controller may activate the external pump responsive to receiving the signal from the sensor, thus enabling automatic transfer of water/additives from the external reservoir to the tree stand without user intervention.

The present disclosure discloses a hydroponic feed indication apparatus that enables the user to conveniently add water to the tree stand. Since the apparatus includes an ergonomic body, the user may not be required to bend to add water to the tree stand and the apparatus may be stably secured in the tree stand. Further, the fill level indicator illuminates when the water level in the tree stand reaches the maximum level desired by the user, thus preventing overfilling of water and/or water spillage. Furthermore, the fill level indicator illuminates in a predetermined pattern when the water level drops below a threshold value, thus providing an indication to the user that water may need to be replenished in the tree stand.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

FIG. 1 depicts an example environment 100 in which techniques and structures for providing the systems and methods disclosed herein may be implemented. The environment 100 may include a Christmas tree 105 that may be placed indoors in a tree stand 110. The Christmas tree 105 may be of any type including, but not limited to, Balsam fir, Douglas fir, Noble fir, White fir, Blue spruce, Deodar cedar, Leyland cypress, and/or the like. Further, the Christmas tree 105 may be of any height in a range of 3 to 12 feet.

The tree stand 110 may have a stand first portion 115 and a stand second portion 120. The stand first portion 115 may be a hollow cylinder configured to house tree trunk in a stand first portion interior part, thus enabling placement of the Christmas tree 105 in the tree stand 110. A stand first portion height and a stand first portion diameter may be based on Christmas tree height and tree trunk diameter. Further, the stand second portion 120 may be a circular, square or rectangular plate that may provide base to the tree stand 110. The tree stand 110 may be placed on ground via the stand second portion 120. Stand second portion dimensions (e.g., diameter or edge width) may be based on Christmas tree dimensions. For example, for a large Christmas tree, the stand second portion dimensions may be large. The stand first portion 115 may be perpendicularly attached to the stand second portion 120, and the stand first and second portions 115, 120 may form a unitary structure of the tree stand 110. In some aspects, the stand first portion 115 and the stand second portion 120 may be made of same material. In other aspects, the stand first portion 115 and the stand second portion 120 may be made of different materials. For example, the stand first and second portions 115, 120 may be made of plastic, fiber, or metal such as steel, iron, aluminum, and/or the like.

In addition to housing the tree trunk, the stand first portion interior part may be configured to receive and hold fluid, e.g., water, which may assist in keeping the Christmas tree 105 alive and healthy for a longer time duration. Specifically, since the Christmas tree 105 may be placed indoors in the tree stand 110, the Christmas tree 105 may require regular watering to keep the Christmas tree 105 in a healthy state. A user 125 may add water to the stand first portion 115 so that the Christmas tree 105 (specifically, the tree trunk) may be hydrated.

In some aspects, the user 125 may use a hydroponic feed indication apparatus 130 (or apparatus 130) to add water to the stand first portion 115. The apparatus 130 may include a hollow body having a proximal body portion 135, a distal body portion 140 and a middle body portion 145 disposed between the proximal body portion 135 and the distal body portion 140. The proximal body portion 135, the middle body portion 145, and the distal body portion 140 may form a unitary structure of the apparatus 130. The proximal body portion 135, the middle body portion 145, and the distal body portion 140 may be made of same or different materials. For example, the proximal body portion 135, the middle body portion 145, and the distal body portion 140 may be made of plastic, Polyvinyl Chloride (PVC) or fiber, or metal such as steel, iron, aluminum, and/or the like.

The user 125 may pour water in the apparatus 130 via the proximal body portion 135. In some aspects, the proximal body portion 135 may be shaped as a funnel or may have any other similar shape that may make it convenient for the user 125 to pour water in the proximal body portion 135. The middle body portion 145 may be shaped as an elongated hollow cylinder or cuboid that may transfer the water from the proximal body portion 135 to the distal body portion 140. The distal body portion 140 may be configured to be inserted into the stand first portion 115 (specifically into the stand first portion interior part), thus enabling water transfer from the middle body portion 145 into the stand first portion 115.

In some aspects, the distal body portion 140 may be shaped as a hollow flattened oval, rectangle, or any other similar shape that may enable the distal body portion 140 to be conveniently inserted into the stand first portion 115. Dimensions of the proximal body portion 135, the middle body portion 145, and the distal body portion 140 may vary based on the dimensions of the Christmas tree 105 and the tree stand 110. In an exemplary aspect, a proximal body portion top end diameter (i.e., funnel top end diameter) may be 2 to 5 times a proximal body portion bottom end diameter (i.e., funnel bottom end diameter), which may be same as the middle body portion diameter. Furthermore, a distal body portion width may be same as the middle body portion diameter. In additional aspects, the middle body portion 145 may include telescoping means (not shown) that may enable the user 125 to change apparatus length.

The apparatus 130 may additionally include one or more fill level indicators (shown as fill level indicator 530 in FIG. 5) that may provide an indication (e.g., water overfilling indication) to the user 125 when a water level in the stand first portion 115 may be higher than a first predefined threshold. In some aspects, the fill level indicator may illuminate in a first pattern (e.g., continuously illuminate with same luminosity) and/or output a first audio notification when the water level in the stand first portion 115 may be higher than the first predefined threshold. Responsive to viewing the illumination and/or receiving the first audio notification, the user 125 may stop pouring further water in the proximal body portion 135. In this manner, the apparatus 130 may prevent the user 125 from overfilling water in the stand first portion 115, thus minimizing water spillage.

In further aspects, the fill level indicator may illuminate in a second pattern (e.g., flash light at a predefined frequency for a time duration of 30-60 seconds) and/or output a second audio notification when the water level in the stand first portion 115 may be lower than a second predefined threshold. In this case, the illumination and/or the second audio notification may indicate that the water level in the stand first portion 115 may be low, and hence the user 125 may need to replenish water in the stand first portion 115. In this manner, the apparatus 130 may prevent the Christmas tree 105 from getting dehydrated.

In additional aspects, the apparatus 130 may include a controller (shown as controller 540 in FIG. 5) that may be communicatively coupled with a user device associated with the user 125. The controller may transmit one or more notifications to the user device when the water level in the stand first portion 115 may be lower than the second predefined threshold and/or when the water level may be higher than the first predefined threshold. In some aspects, the controller may be further connected with a water pump. The controller may activate the water pump when the water level in the stand first portion 115 may be lower than the second predefined threshold. Stated another way, the controller may automatically activate the water pump when the water level in the stand first portion 115 may be low (i.e., when the Christmas tree 105 may require hydration). Responsive to water pump activation, the water pump may automatically transfer a predefined amount of water from an external reservoir to the stand first portion 115 via the apparatus 130 (specifically via the proximal body portion 135). In this manner, the apparatus 130 may automatically fill water in the stand first portion 115 without requiring user intervention.

Structural and functional details of the apparatus 130 are described in detail in conjunction with subsequent figures.

Figure 2:
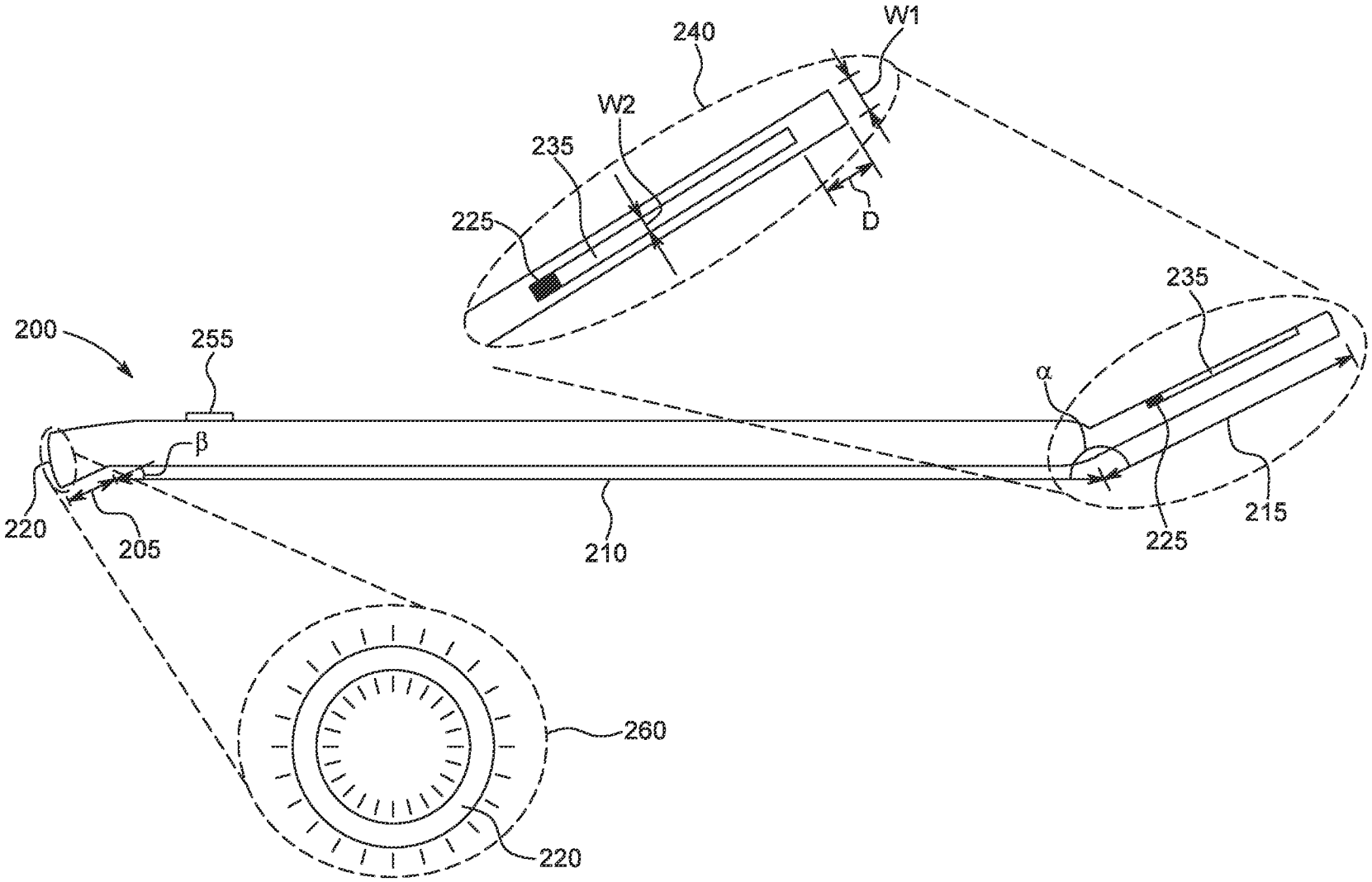
FIG. 2 depicts a side view of an example hydroponic feed indication apparatus in accordance with the present disclosure.

FIG. 2 depicts a side view of an example hydroponic feed indication apparatus 200 (or apparatus 200) in accordance with the present disclosure. The apparatus 200 may be same as the apparatus 130 described above in conjunction with FIG. 1. While describing FIG. 2, references may be made to FIG. 3 that depicts a front view of the apparatus 200, in accordance with the present disclosure. Specifically, FIG. 3 depicts an interior front view of the apparatus 200.

The apparatus 200 may include a body having a proximal body portion 205, a middle body portion 210, and a distal body portion 215. The proximal body portion 205, the middle body portion 210, and the distal body portion 215 may be same as the proximal body portion 135, the middle body portion 145 and the distal body portion 140 described above in conjunction with FIG. 1. As described above, the distal body portion 215 may be configured to be inserted into the tree stand 110, and the proximal body portion 205 may be configured to receive fluid (e.g., water) via a proximal body portion top end 220.

The apparatus 200 may have an ergonomic shape such that it may be convenient for the user 125 to pour water into the proximal body portion top end 220, insert the distal body portion 140 into the tree stand 110, and stably secure the apparatus 200 in the tree stand 110. For example, in an exemplary aspect, a middle body portion longitudinal axis may be disposed at a first predefined angle "α" relative to a distal body portion longitudinal axis, as shown in FIG. 2. The angle "α" may be in a range of 15 to 30 degrees. In a preferred aspect, the angle "α" may be 25 degrees. In a similar manner, the middle body portion longitudinal axis may be disposed at a second predefined angle "β" relative to a proximal body portion longitudinal axis. The angle "β" may be in range of 15 to 45 degrees. In some aspects, the angle "α" may be same as the angle "β". In other aspects, the angle "α" may be different from the angle "β".

Figure 3:
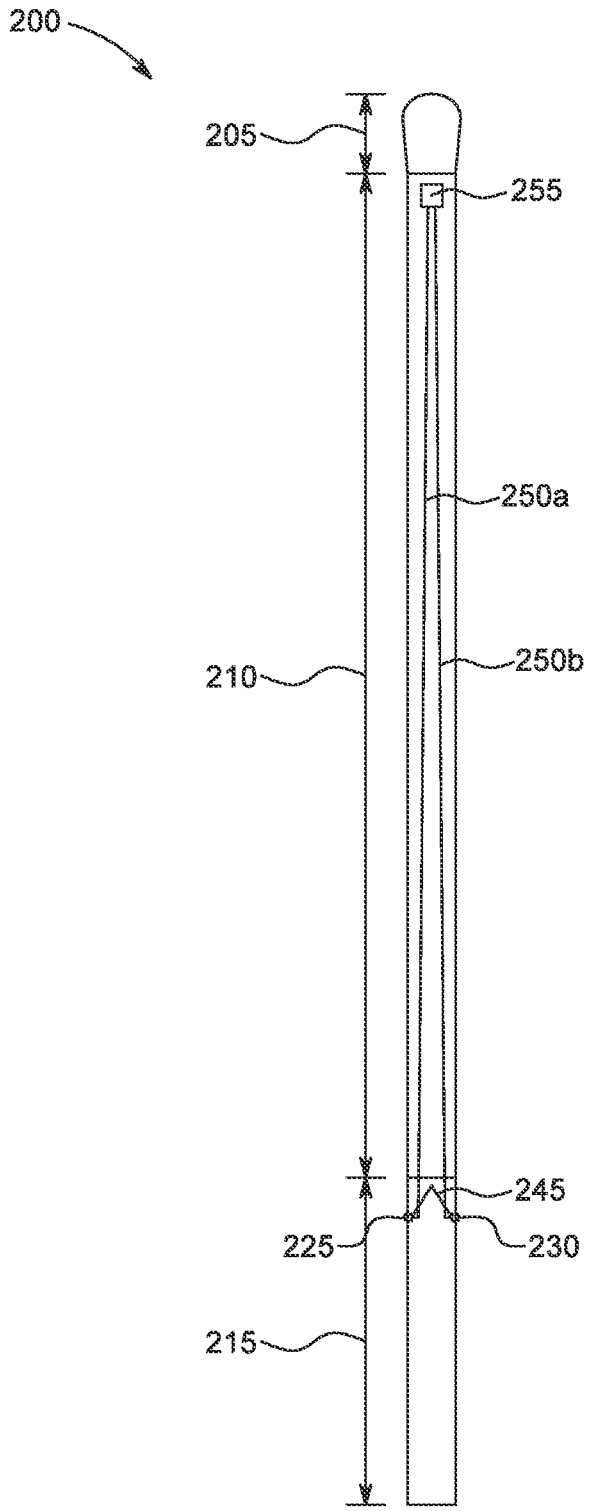
FIG. 3 depicts a front view of the hydroponic feed indication apparatus of FIG. 2 in accordance with the present disclosure.

The apparatus 200 may further include a first electrically conducting electrode 225 and a second electrically conducting electrode 230, as shown in FIG. 3. The first electrically conducting electrode 225 may be, for example, an anode electrode (hereinafter referred to as anode electrode 225), and the second electrically conducting electrode 230 may be a cathode electrode (hereinafter referred to as cathode electrode 230).

As shown in FIGS. 2 and 3, the anode electrode 225 and the cathode electrode 230 may be disposed at a distal body portion exterior surface. In some aspects, the anode electrode 225 and the cathode electrode 230 may be disposed on opposing ends (e.g., left and right ends) of the distal body portion exterior surface. In other aspects, the anode electrode 225 and the cathode electrode 230 may not be disposed on opposing ends of the distal body portion exterior surface; instead, the anode electrode 225 and the cathode electrode 230 may be disposed anywhere on the distal body portion exterior surface such that the anode electrode 225 and the cathode electrode 230 may not touch each other.

The apparatus 200 may further include a first elongated slit 235 (as shown in FIG. 2) disposed on the distal body portion 215, using which the anode electrode 225 may move up or down along a distal body portion length. Specifically, the user 125 may slide the anode electrode 225 along the distal body portion length via the first elongated slit 235. In a similar manner, the apparatus 200 may include a second elongated slit (not shown) disposed on the distal body portion 215, using which the cathode electrode 230 may move up or down along the distal body portion length. In some aspects, the first elongated slit 235 and the second elongated slit may be disposed on opposing ends of the distal body portion 215 that may enable the user 125 to slide the anode electrode 225 and the cathode electrode 230 along the distal body portion length. In other aspects, the first elongated slit 235 and the second elongated slit may be disposed anywhere on the distal body portion 215 such that the anode electrode 225 and the cathode electrode 230 may not touch each other when the electrodes are moved up or down along the distal body portion length.

In some aspects, only one electrode of the anode electrode 225 and the cathode electrode 230 may be configured to move up or down along the distal body portion length. In this case, one electrode (e.g., the cathode electrode 230) may be fixed in proximity to a bottom end of the distal body portion, and the second electrode (e.g., the anode electrode 225) may be configured to move up or down along the distal body portion length. In other aspects, both the anode and cathode electrodes 225, 230 may be configured to move up or down along the distal body portion length.

The first elongated slit 235 and the second elongated slit may be disposed parallel to each other, and may have equivalent dimensions. For example, for a distal body portion having a width "W1" (shown in view 240 of FIG. 2) in a range of 0.3 to 0.5 inches, a width "W2" of the first elongated slit 235 and the second elongated slit may be in a range of 0.1 to 0.2 inches. Further, in some aspects, lengths of the first elongated slit 235 and the second elongated slit may be same, and may be equivalent to the distal body portion length. In other aspects, lengths of the first elongated slit 235 and the second elongated slit may be less than the distal body portion length. For example, as shown in the view 240, lengths of the first elongated slit 235 and the second elongated slit may be less than the distal body portion length such that bottom ends of the first elongated slit 235 and the second elongated slit may disposed at a predefined distance "D" from a distal body portion bottom end. The distance "D" may be in a range of 0.5 to 1.5 inches.

In some aspects, the first elongated slit 235 and the second elongated slit may have serrated edges (not shown) along slit lengths. Further, the anode electrode 225 and the cathode electrode 230 may be connected with each other in a distal body portion interior part via an electrically non-conductive V-shaped spring 245, as shown in FIG. 3. The V-shaped spring 245 may be made of plastic or any other similar electrically non-conductive material, such that the V-shaped spring 245 may not short the anode electrode 225 and the cathode electrode 230. In an exemplary aspect, when the user 125 slides up or down the anode and/or cathode electrodes 225, 230 along the distal body portion length, the V-shaped spring 245 may "lock" against the slit serrated edges (e.g., by creating tension against the slit serrated edges) so that the anode and cathode electrodes 225, 230 may stay at any position on the distal body portion 215 where the user 125 may leave the anode and cathode electrodes 225, 230. Stated another way, if the user 125 desires to move the anode and cathode electrodes 225, 230 such that the anode and cathode electrodes 225, 230 may be three inches from the distal body portion bottom end, the user 125 may move and leave the anode and cathode electrodes 225, 230 three inches from the distal body portion bottom end. In this case, the V-shaped spring 245 and the serrated slit edges may ensure that the anode and cathode electrodes 225, 230 stay at the position on the distal body portion 215 that is three inches from the distal body portion bottom end.

A person ordinarily skilled in the art may appreciate from the description above that the V-shaped spring 245 and the serrated slit edges may enable the user 125 to move and lock the anode and cathode electrodes 225, 230 at any position along the distal body portion length. The present disclosure is not limited to the arrangement of V-shaped spring 245 and the serrated slit edges to move and lock the anode and cathode electrodes 225, 230 on the distal body portion 215. Any other similar structural arrangement may be used in the apparatus 200, without departing from the present disclosure scope. For example, the V-shaped spring 245 may be replaced with a semi-circular or semi-oval shaped spring.

The apparatus 200 may further include a first insulated wire 250*a*, a second insulated wire 250*b* and an electronics unit 255, as shown in FIG. 3. The electronics unit 255 may include a plurality of components including, but not limited to, a controller (shown as controller 540 in FIG. 5), a first fill level indicator or a first light emitting diode (LED, shown as fill level indicator 530 in FIG. 5), a power source (e.g., rechargeable batteries, shown as power source 525 in FIG. 5), a speaker (shown as speaker 535 in FIG. 5), and/or the like (not shown). The first insulated wire 250*a* may be disposed in hollow body interior portion (including the interior portions of the middle body portion 210 and the distal body portion 215) of the apparatus 200, and may connect the anode electrode 225 to the electronics unit 255. In some aspects, the first insulated wire 250*a* may be disposed in a separate channel (not shown) in the hollow body interior portion that may prevent water from coming in contact with the first insulated wire 250*a*. Similarly, the second insulated wire 250*b* too may be disposed in the hollow body interior portion (and in a separate channel), and may connect the cathode electrode 230 to the electronic unit 255. In some aspects, when the anode electrode 225 and the cathode electrode 230 may be shorted, e.g., due to presence of water in the distal body portion exterior surface, a circuit including the anode electrode 225, the cathode electrode 230, the first insulated wire 250*a*, the second insulated wire 250*b* and the electronics unit 255 may be complete or in "connected state". Responsive to the circuit being in the connected state, the first fill level indicator and/or the speaker included in the electronics unit 255 may be activated. In this manner, the user 125 may receive an indication that the water level around the distal body portion exterior surface may have reached to the level where the anode and cathode electrodes 225, 230 may be placed on the distal body portion 215. A person ordinarily skilled in the art may appreciate from the description above that since water is electrically conductive, the water may short the anode and cathode electrodes 225, 230, which may enable the first fill level indicator and/or the speaker to activate.

In operation, the user 125 may adjust a desired maximum "fill level" of water in the stand first portion 115 by moving the anode and/or cathode electrodes 225, 230 up or down along the distal body portion length. For example, if the user 125 desires to have a maximum water fill level of six inches in the stand first portion 115, the user 125 may move and lock the anode and cathode electrodes 225, 230 on the distal body portion 215 such that the anode and cathode electrodes 225, 230 may be disposed (or "locked") six inches from the distal body portion bottom end. Responsive to locking the anode and cathode electrodes 225, 230 at the desired position on the distal body portion 215, the user 125 may insert the distal body portion 215 in the stand first portion 115, as shown in FIG. 1. The user 125 may then pour water in the apparatus 200 via the proximal body portion top end 220. The water may flow in the stand first portion 115 and may start to fill the stand first portion 115. When the water level in the stand first portion 115 reaches to a level of six inches (from tree stand base), the anode and cathode electrodes 225, 230 may short and thus result in first fill level indicator illumination and/or output of an audio notification from the speaker. In this manner, the user 125 may receive an indication that the water level in the stand first portion 115 may have reached the desired level, and the user 125 may then stop pouring further water in the proximal body portion top end 220. Therefore, the apparatus 200 may prevent the user 125 from overfilling the stand first portion 115 and hence minimizes water spillage.

In some aspects, in addition to or alternative to the first fill level indicator being disposed in the electronics unit 255, the first fill level indicator may be disposed at the proximal body portion top end 220, as shown in view 260 of FIG. 2. In this case, when the anode and cathode electrodes 225, 230 may be shorted, the proximal body portion top end 220 may illuminate, thus providing a clear and unobstructed view of illuminated first fill level indicator to the user 125. In some aspects, the first fill level indicator may be disposed along an entire periphery of the proximal body portion top end 220, as shown in the view 260. In other aspects (not shown), the first fill level indicator may be disposed at one or more portions on the circumference of the proximal body portion top end 220.

Figure 4:
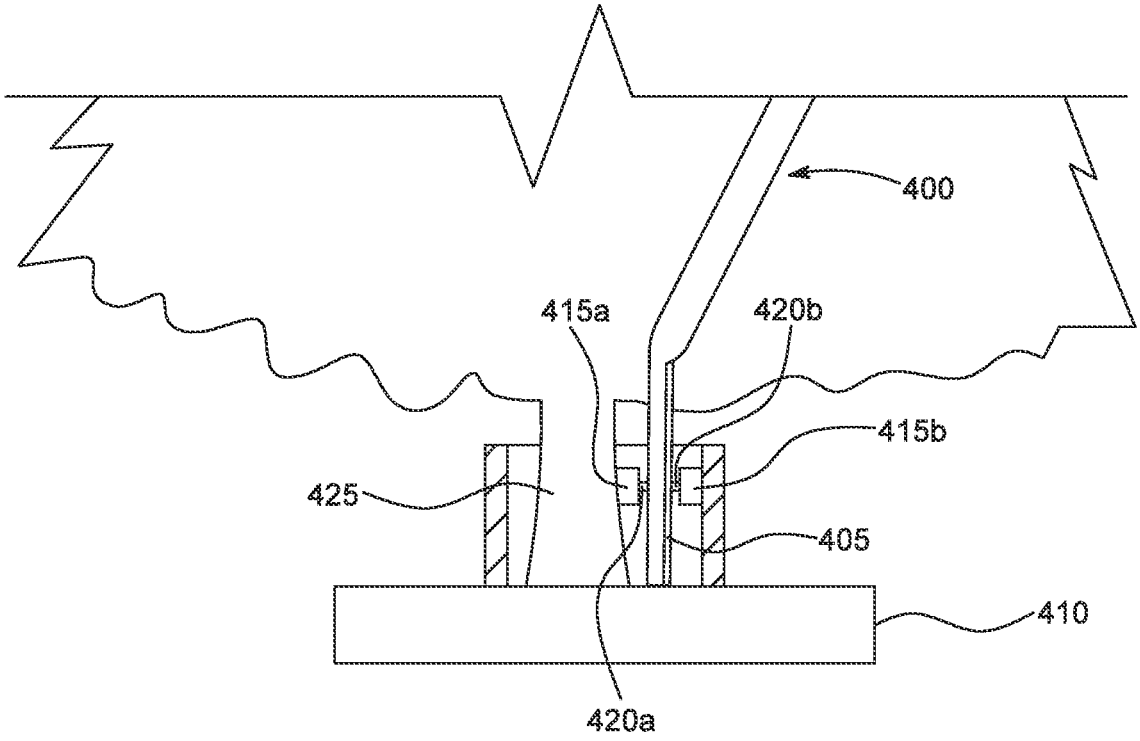
FIG. 4 depicts a distal body portion of an example hydroponic feed indication apparatus attached to a tree stand in accordance with the present disclosure.

FIG. 4 depicts a distal body portion 405 of an example hydroponic feed indication apparatus 400 (or apparatus 400) attached to a tree stand 410 in accordance with the present disclosure. The distal body portion 405 may be same as the distal body portion 215, the tree stand 410 may be same as the tree stand 110, and the apparatus 400 may be same as the apparatus 200.

As described above, the user 125 may insert the distal body portion 405 into the tree stand 410 to place the apparatus 400 in the tree stand 410. To ensure that the distal body portion 405 is stably secured in the tree stand 410 (and does not move or waver), in some aspects, the distal body portion 405 may include a first spacer 415*a* and a second spacer 415*b* that may be attached to a distal body portion exterior surface. In an exemplary aspect, if the distal body portion 405 is shaped as a flattened oval or rectangle, the first and second spacers 415*a*, 415*b* may be attached to opposing flattened exterior surfaces of the distal body portion 405. The first and second spacers 415*a*, 415*b* may be made of foam rubber such that the first and second spacers 415*a*, 415*b* may be compressible.

In some aspects, the first and second spacers 415*a*, 415*b* may be removably attached to the distal body portion exterior surface by using an adhesive or Velcro™. The user 125 may attach the first and second spacers 415*a*, 415*b* to any portion of the distal body portion exterior surface along the distal body portion length, based on distal body portion dimensions. In other aspects, the first and second spacers 415*a*, 415*b* may be removably attached to the distal body portion exterior surface via one or more clamps 420*a*, 420*b* (e.g., C-clamps) as shown in FIG. 4. In this case, the clamps 420*a*, 420*b* may be attached to the distal body portion exterior surface via one or more fasteners (not shown) that may include, but are not limited to, bolts, screws, nuts, and/or the like. In some aspects, the clamps 420*a*, 420*b* may be configured to be attached to the distal body portion exterior surface at different portions of the distal body portion exterior surface along the distal body portion length. In other aspects, the clamps 420*a*, 420*b* may be configured to move (and lock) or slide along the distal body portion length. The user 125 may removably attach the first and second spacers 415*a*, 415*b* to the clamps 420*a*, 420*b*, thus securing the first and second spacers 415*a*, 415*b* to the distal body portion exterior surface.

As shown in FIG. 4, the first spacer 415*a* may wedge between tree trunk 415 and the distal body portion exterior surface, and the second spacer 415*b* may wedge between tree stand interior wall and the distal body portion exterior surface. Since the first and second spacers 415*a*, 415*b* are made of foam rubber, wedging the first and second spacers 415*a*, 415*b* between the distal body portion exterior surface and the tree trunk 415/tree stand interior wall may provide secure attachment or placement of the distal body portion 405 in the tree stand 410.

Figure 5:
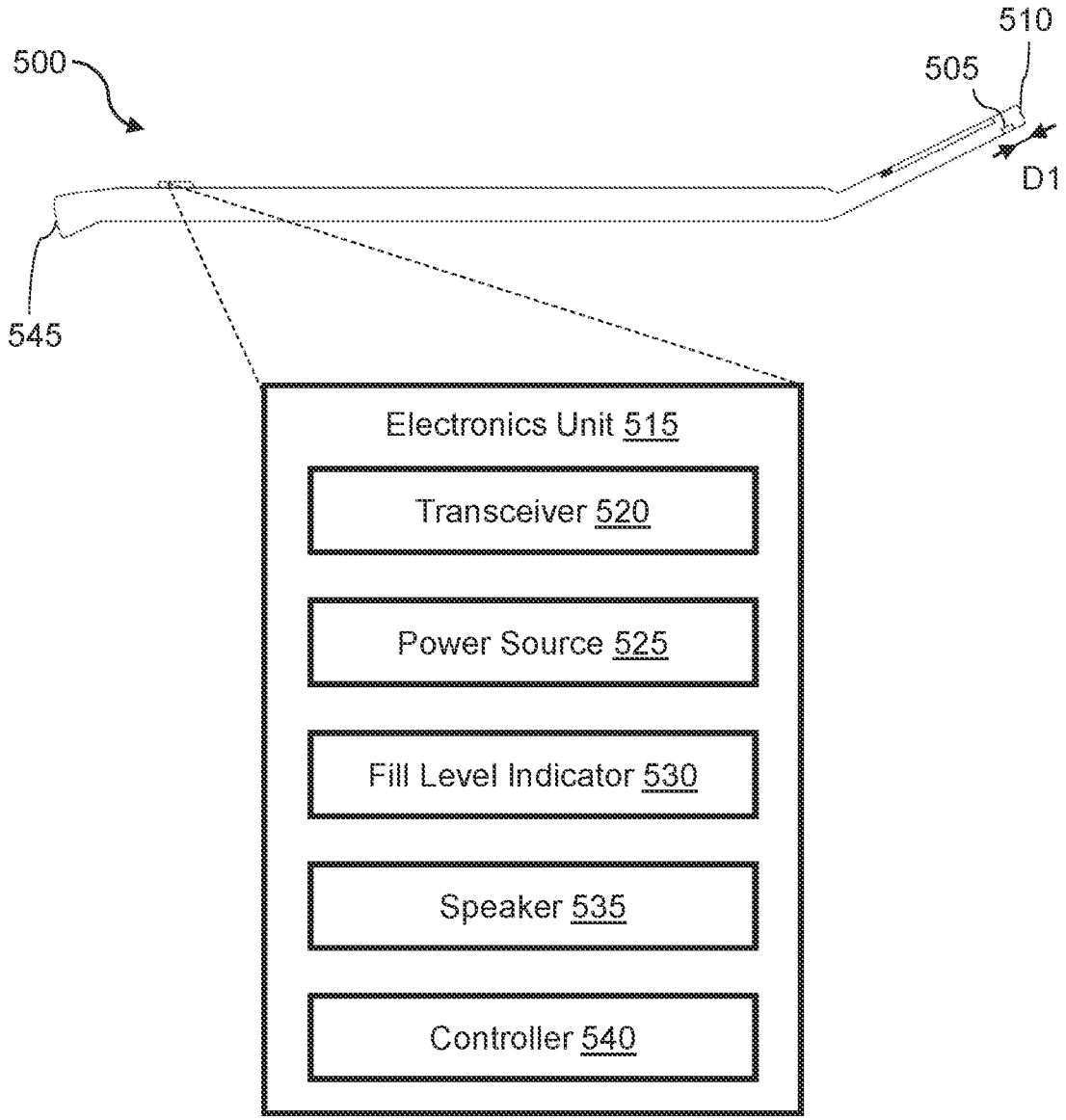
FIG. 5 depicts a side view of another example hydroponic feed indication apparatus in accordance with the present disclosure.

FIG. 5 depicts a side view of another example hydroponic feed indication apparatus 500 (or apparatus 500) in accordance with the present disclosure. The apparatus 500 may be similar to the apparatus 200; however, in addition to the components described in conjunction with the apparatus 200, the apparatus 500 may include a water level detection sensor 505 (or sensor 505). In some aspects, the sensor 505 may be configured to detect water level using similar components as described above, e.g., anode and cathode electrodes, insulated wires, V-spring, etc. In other aspects, the sensor 505 may be configured to detect water level using other components or other water level detection mechanism. In an exemplary aspect, the sensor 505 may be disposed at the distal body portion exterior surface and at a predetermined distance "D1" from a distal body portion bottom end 510. The distance "D1" may be adjustable by the user 125. Stated another way, the user 125 may slide and lock the sensor 505 along the distal body portion length at any position on the distal body portion exterior surface. The sensor 505 may be configured to move along the distal body portion length using the same movement mechanism/components described above in conjunction with movement of the anode and cathode electrodes 225, 230.

The sensor 505 may be configured to generate a signal when the sensor 505 is not in contact with water. For example, the sensor 505 may generate a signal when the apparatus 500 may be placed in the tree stand 410, and water level in the tree stand 410 may drop below a predefined threshold value (e.g., distance "D1" from tree stand bottom surface) such that water may not be in contact with the sensor 505. When the water may not be in contact with the sensor 505, it may indicate that the water may need to be replenished in the tree stand 410. Therefore, the sensor 505 may be configured to generate the signal when water needs to be replenished in the tree stand 410.

The sensor 505 may be configured to transmit the generated signal to an electronics unit 515, which may be same as the electronics unit 255. The electronics unit 515 may include a plurality of components including, but not limited to, a transceiver 520, a power source 525, a fill level indicator or light emitting diode 530, a speaker 535 and a controller 540. The power source 525 may include rechargeable batteries may power various components of the electronics unit 255. In some aspects, the sensor 505 may transmit the generated signal to the transceiver 520, which may send the signal to the controller 540. In some aspects, the fill level indicator 530 may be part of the electronics unit 255, as shown in FIG. 5. In other aspects, the fill level indicator 530 may be disposed at a proximal body portion top end 545, as described above in conjunction with FIG. 2. In yet another aspect, the apparatus 500 may include more than one fill level indicators.

Responsive to receiving the signal from the sensor 505, the controller 540 may activate/illuminate the fill level indicator 530 and/or cause the speaker 535 to output a predetermined sound (e.g., a predetermined song). In some aspects, the controller 540 may illuminate the fill level indicator 530 in a specific pattern (e.g., flash the fill level indicator 530) so that the user 125 may receive an indication that water may need to be replenished in the tree stand 410. In additional or alternative aspects, the controller 540 may cause the proximal body portion top end 545 to flash (e.g., when the fill level indicator 530 may disposed at the proximal body portion top end 545) as described above in conjunction with FIG. 1, indicating to the user 125 that the tree stand 410 may need water. In further aspects, responsive to receiving the signal from the sensor 505, the controller 540 may transmit, via the transceiver 520 and a wireless network (not shown), an alert notification to a user device (not shown) associated with the user 125 indicating that the water may need to be replenished in the tree stand 410.

In additional aspects, the controller 540 may be mechanically and/or electrically connected with an external pump (not shown) that may be configured to pump water from an external reservoir to the apparatus 500 (specifically to the proximal body portion top end 545). Responsive to receiving the signal from the sensor 505, the controller 540 may transmit an activation signal to the external pump. The external pump may pump a predetermined amount of water from the external reservoir to the proximal body portion top end 545, when the external pump receives the activation signal from the controller 540. In this manner, the controller 540 may enable the tree stand 410 to automatically get replenished with water, without human intervention.

In some aspects, the external reservoir may include water. In other aspects, the external reservoir may include a predetermined ratio of water and additives that may enable Christmas tree leaves to stay green for a longer time duration.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An apparatus comprising:

a hollow body having a distal body portion and a proximal body portion, wherein:

the distal body portion is configured to be inserted into a tree stand, and the proximal body portion is configured to receive fluid via a proximal body portion top end, wherein the tree stand is configured to receive the fluid via the hollow body;

an anode electrode disposed at a distal body portion exterior surface, wherein the anode electrode is configured to move along a distal body portion length via a first elongated slit disposed on the distal body portion;

a cathode electrode disposed at the distal body portion exterior surface; and a first fill level indicator disposed on the hollow body, wherein the first fill level indicator is configured to activate when the anode electrode and the cathode electrode are shorted by the fluid in the tree stand.

2. The apparatus of claim 1 further comprising a middle body portion disposed between the distal body portion and the proximal body portion.

3. The apparatus of claim 2, wherein a middle body portion longitudinal axis is disposed at a first predefined angle relative to a distal body portion longitudinal axis.

4. The apparatus of claim 3, wherein the middle body portion longitudinal axis is disposed at a second predefined angle relative to a proximal body portion longitudinal axis.

5. The apparatus of claim 1 further comprising a V-shaped spring disposed in a hollow body interior portion, wherein the anode electrode and the cathode electrode are connected to each other in the hollow body interior portion via the V-shaped spring.

6. The apparatus of claim 1, wherein the cathode electrode is configured to move along the distal body portion length via a second elongated slit disposed on the distal body portion.

7. The apparatus of claim 1, wherein the first fill level indicator is disposed at the proximal body portion top end.

8. The apparatus of claim 1 further comprising a first spacer and a second spacer attached to the distal body portion exterior surface, wherein the first spacer is configured to wedge between a tree stand interior wall and the distal body portion exterior surface, and wherein the second spacer is configured to wedge between a tree trunk and the distal body portion exterior surface.

9. The apparatus of claim 8, wherein the first spacer and the second spacer are attached to the distal body portion exterior surface via one or more clamps, and wherein the one or more clamps are configured to move along the distal body portion length.

10. The apparatus of claim 1 further comprising a first insulated wire and a second insulated wire, wherein the anode electrode is attached to the first fill level indicator via the first insulated wire, and wherein the cathode electrode is attached to the first fill level indicator via the second insulated wire.

11. The apparatus of claim 1 further comprising:

a sensor disposed at the distal body portion exterior surface, wherein the sensor is configured to generate a signal when a fluid level in the tree stand is below a predefined threshold level;

a second fill level indicator disposed on the hollow body; and a controller configured to receive the signal from the sensor and activate the second fill level indicator responsive to receiving the signal.

12. The apparatus of claim 11, wherein the controller is further configured to transmit an alert notification to a user device responsive to receiving the signal.

13. The apparatus of claim 11, wherein the controller is further configured to transmit an activation signal to an external pump responsive to receiving the signal, and wherein the external pump is configured to transfer the fluid from an external reservoir to the tree stand when the external pump is activated.

14. An apparatus comprising:

a hollow body having a distal body portion and a proximal body portion, wherein:

the distal body portion is configured to be inserted into a tree stand, and the proximal body portion is configured to receive fluid via a proximal body portion top end, wherein the tree stand is configured to receive the fluid via the hollow body;

an anode electrode and a cathode electrode disposed at a distal body portion exterior surface, wherein the anode electrode is configured to move along a distal body portion length via an elongated slit disposed on the distal body portion;

a fill level indicator disposed on the hollow body, wherein the fill level indicator is configured to activate when the anode electrode and the cathode electrode are shorted by the fluid in the tree stand; and a first insulated wire and a second insulated wire, wherein the anode electrode is attached to the fill level indicator via the first insulated wire, and wherein the cathode electrode is attached to the fill level indicator via the second insulated wire.

15. The apparatus of claim 14 further comprising a V-shaped spring disposed in a hollow body interior portion, wherein the anode electrode and the cathode electrode are connected to each other in the hollow body interior portion via the V-shaped spring.

16. The apparatus of claim 14, wherein the proximal body portion is funnel-shaped.

17. The apparatus of claim 14, wherein the fill level indicator is disposed at the proximal body portion top end.

18. The apparatus of claim 14 further comprising a first spacer and a second spacer attached to the distal body portion exterior surface, wherein the first spacer is configured to wedge between a tree stand interior wall and the distal body portion exterior surface, and wherein the second spacer is configured to wedge between a tree trunk and the distal body portion exterior surface.

19. The apparatus of claim 18, wherein the first spacer and the second spacer are attached to the distal body portion exterior surface via one or more clamps, and wherein the one or more clamps are configured to move along the distal body portion length.

20. An apparatus comprising:

a hollow body having a distal body portion and a proximal body portion, wherein:

the distal body portion is configured to be inserted into a tree stand, and the proximal body portion is configured to receive fluid via a proximal body portion top end, wherein the tree stand is configured to receive the fluid via the hollow body;

an anode electrode and a cathode electrode disposed at a distal body portion exterior surface, wherein the anode electrode is configured to move along a distal body portion length via a first elongated slit disposed on the distal body portion, and wherein the cathode electrode is configured to move along the distal body portion length via a second elongated slit disposed on the distal body portion;

a fill level indicator disposed on the hollow body, wherein the fill level indicator is configured to activate when the anode electrode and the cathode electrode are shorted by the fluid in the tree stand; and a first spacer and a second spacer attached to the distal body portion exterior surface, wherein the first spacer is configured to wedge between a tree stand interior wall and the distal body portion exterior surface, and wherein the second spacer is configured to wedge between a tree trunk and the distal body portion exterior surface.

* * * * *